US005529061A

United States Patent [19]

Sanders

[11] Patent Number: 5,529,061

[45] Date of Patent: Jun. 25, 1996

[54] JACKET SUPPORTED PRESSURIZED 02 COIL

[75] Inventor: Stan A. Sanders, 420 29th St., Hermosa Beach, Calif. 90530

[73] Assignees: Stan A. Sanders; William F. Meistrell, Sr, both of Rancho Palos Verdes, Calif.; a part interest

[21] Appl. No.: 368,302

[22] Filed: Jan. 3, 1995

[51] Int. Cl.[6] ..... A62B 7/02

[52] U.S. Cl. ..... 128/205.22; 128/204.18

[58] Field of Search ..... 128/205.22, 204.18, 128/200.24

[56] References Cited

U.S. PATENT DOCUMENTS

| | | | |
|---|---|---|---|
| 771,801 | 10/1904 | Andrew . | |
| 789,145 | 5/1905 | Derx . | |
| 2,380,372 | 7/1945 | Alderfer | 128/205.22 |
| 2,982,105 | 5/1961 | Akers | 128/205.22 |
| 3,491,752 | 1/1970 | Cowley . | |
| 4,090,509 | 5/1976 | Smith . | |
| 4,253,454 | 3/1981 | Warncke . | |
| 4,932,403 | 6/1990 | Scholley . | |
| 4,964,405 | 10/1990 | Arnoth | 128/205.22 |
| 5,036,845 | 8/1991 | Scholley . | |
| 5,127,399 | 7/1992 | Scholley . | |

FOREIGN PATENT DOCUMENTS

| | | | |
|---|---|---|---|
| 4007274 | 9/1991 | Germany | 128/204.18 |

*Primary Examiner*—Edgar S. Burr
*Assistant Examiner*—William J. Deane, Jr.
*Attorney, Agent, or Firm*—William W. Haefliger

[57] ABSTRACT

A clothing jacket carried pressurized gas assembly comprising a jacket back panel structure; first looping pipe coil structure carried by the jacket in overlying relation to the back panel structure and having flexible construction, whereby the coil structure and back panel structure may be conformed to the body of the wearer; the looping coil structure having pressurized gas inlet and outlet fittings associated therewith, whereby the looping pipe coil structure may receive pressurized gas for transport by the wearer.

10 Claims, 3 Drawing Sheets

JACKET SUPPORTED PRESSURIZED 02 COIL

BACKGROUND OF THE INVENTION

This invention relates generally to human transport of pressurized gas, and more particularly to a wearable jacket structure incorporating pipe coil structure that contains pressurized gas, such as oxygen, and wherein the pipe coil structure is conformable to the body of the wearer to which such gas is supplied.

There is need for improvements in apparatus to supply gas, such as oxygen, to a human patient needing such supply. Generally, known apparatus comprises an oxygen tank, which is bulky and difficult to transport and wear, as for example strapped to the patient's back. Thus, there is need for oxygen supply apparatus which is conformable to the body of the wearer, and which may be covered up by outer clothing.

To my knowledge, no prior gas supply apparatus incorporated the unusually advantageous features of construction and operation, and produced the highly desirable results, as are now afforded by the present invention.

SUMMARY OF THE INVENTION

It is a major object of the invention to provide improved apparatus meeting the needs, as referred to above. Basically, a clothing jacket carried pressurized gas assembly is provided and characterized by:

a) a jacket back panel structure, b) first looping pipe coil means carried by the jacket structure in overlying relation to the back panel structure and having flexible construction, whereby the coil means and back panel structure may be conformed to the body of the wearer, c) the looping coil means having pressurized gas inlet and outlet fittings associated therewith, whereby the looping pipe coil means may receive pressurized gas for transport by the wearer.

As will be seen, the assembly may include jacket additional panel structure connected with the back panel structure for retaining the back panel structure and coil means to the body of the wearer; and the pipe coil means may extend into overlying relation with the additional panel structure. The jacket additional structure typically includes a jacket side panel or panels, as well as front panel structure. When the jacket is oriented to extend upright, the pipe coil means is extended to include parallel, elongated pipe stretches that extend horizontally in overlying relation with the back panel structure and the jacket additional structure.

Yet another object is to provide second looping pipe coil means carried by the jacket in overlying relation with the back panel structure and above the level of the first pipe coil means, the second pipe means connected with the first pipe means for reception of pressurized gas. Such second pipe coil means, comprising a further reservoir, may have flexible construction to conform to the back of the jacket wearer, above the level of the first coil means. The jacket itself typically consists of flexible material, having left-to-right direction and extends below the arm openings, and the second coil means extends between the arm openings.

A further object is to provide the second pipe coil means to comprise a spiral coil having an outer diameter and the first pipe coil means having left-to-right length at least twice the first pipe coil means diameter.

An additional object is to provide one or both of the first and second pipe coil means to comprise first and second sub-coils extending in layered, adjacent relation.

A further object includes the provision of a protective padding layer extending at one side of the pipe coil means for interposition between the pipe coil means and the body of the wearer. That layer typically extends at one side of each of the first pipe coil means and of the second pipe coil means, for interposition between the pipe coil means and the body of the wearer. Further, flexible cover layers may extend in overlying relation to the first and second pipe coil means at the sides thereof opposite the padding layer.

Pressurized oxygen is typically supplied to the coil means, and valving controls flow of oxygen to an outlet supplying reduced pressure oxygen to the mouth or nose of the jacket wearer.

These and other objects and advantages of the invention, as well as the details of an illustrative embodiment, will be more fully understood from the following specification and drawings, in which:

DRAWING DESCRIPTION

DETAILED DESCRIPTION

Figure 2:
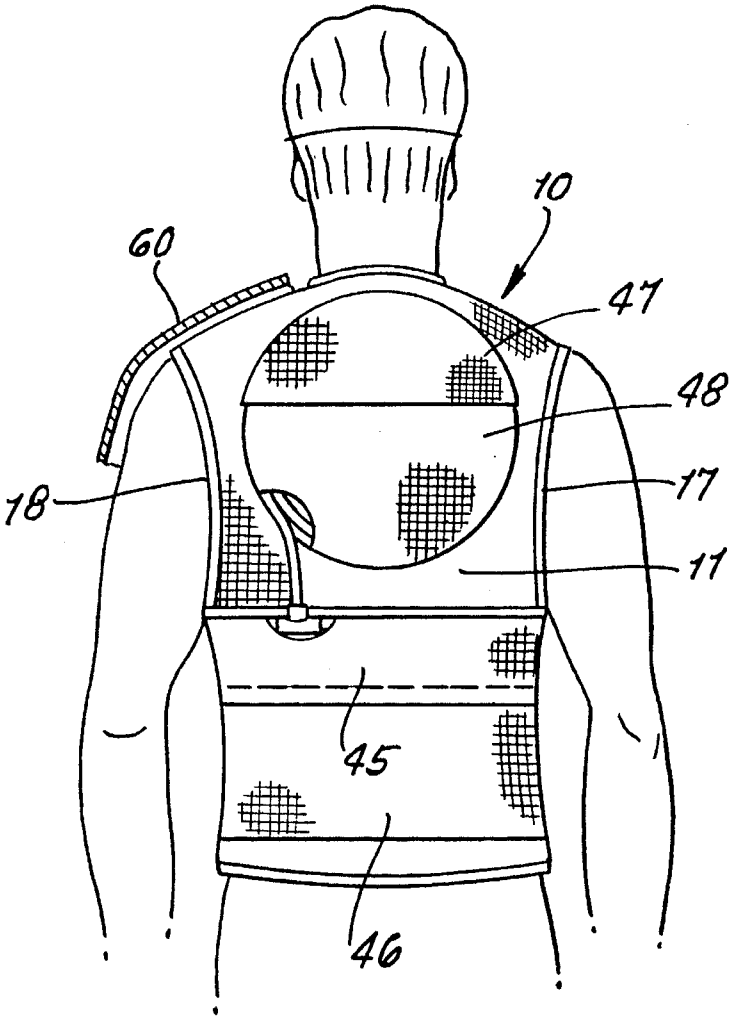
FIG. 2 is a rear view of the FIG. 1 apparatus.
Figure 1:
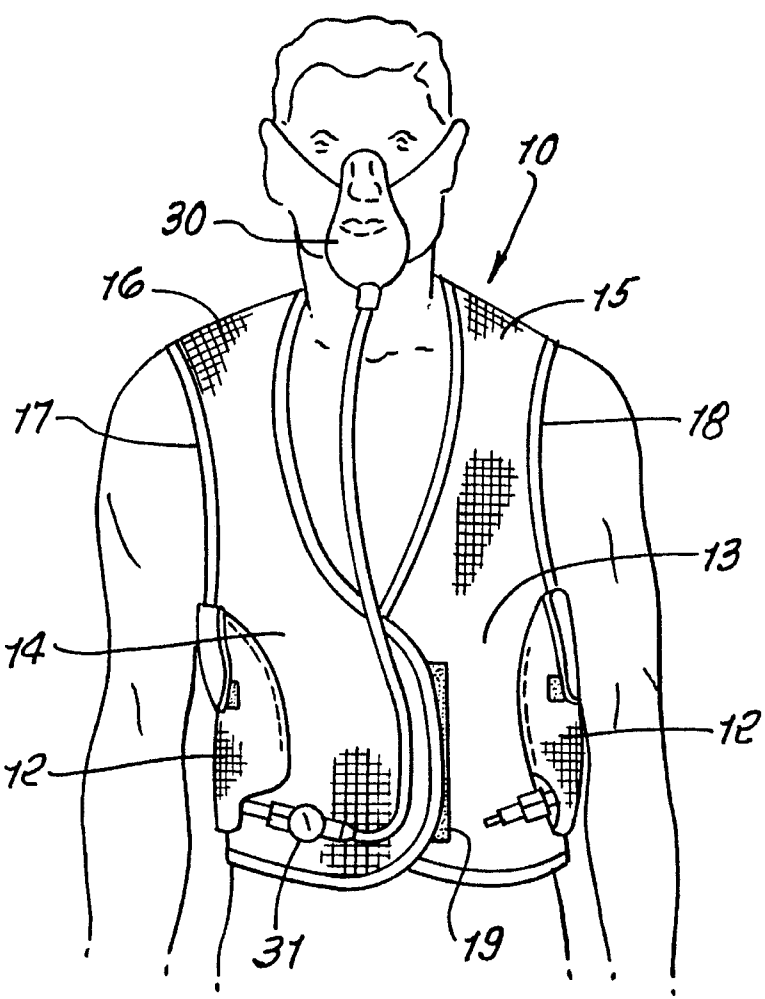
FIG. 1 is a front view of apparatus incorporating the invention.

In FIGS. 1–4, jacket 10 has a back panel 11, side panels 12, front panels 13 and 14, and shoulder panels 15 and 16. Arm openings are formed at 17 and 18. All such elements make up jacket structure, worn for example as shown in FIGS. 1 and 2. Panels 11–16 may consist of flexible material to closely conform to the wearer's body or torso when worn, allowing outer clothing, such as a sweater or coat, to be worn over the jacket. VELCRO connections appear at 19 and 20, to hold the jacket closed. Other type connections may be employed, such as buttons.

Figure 3:
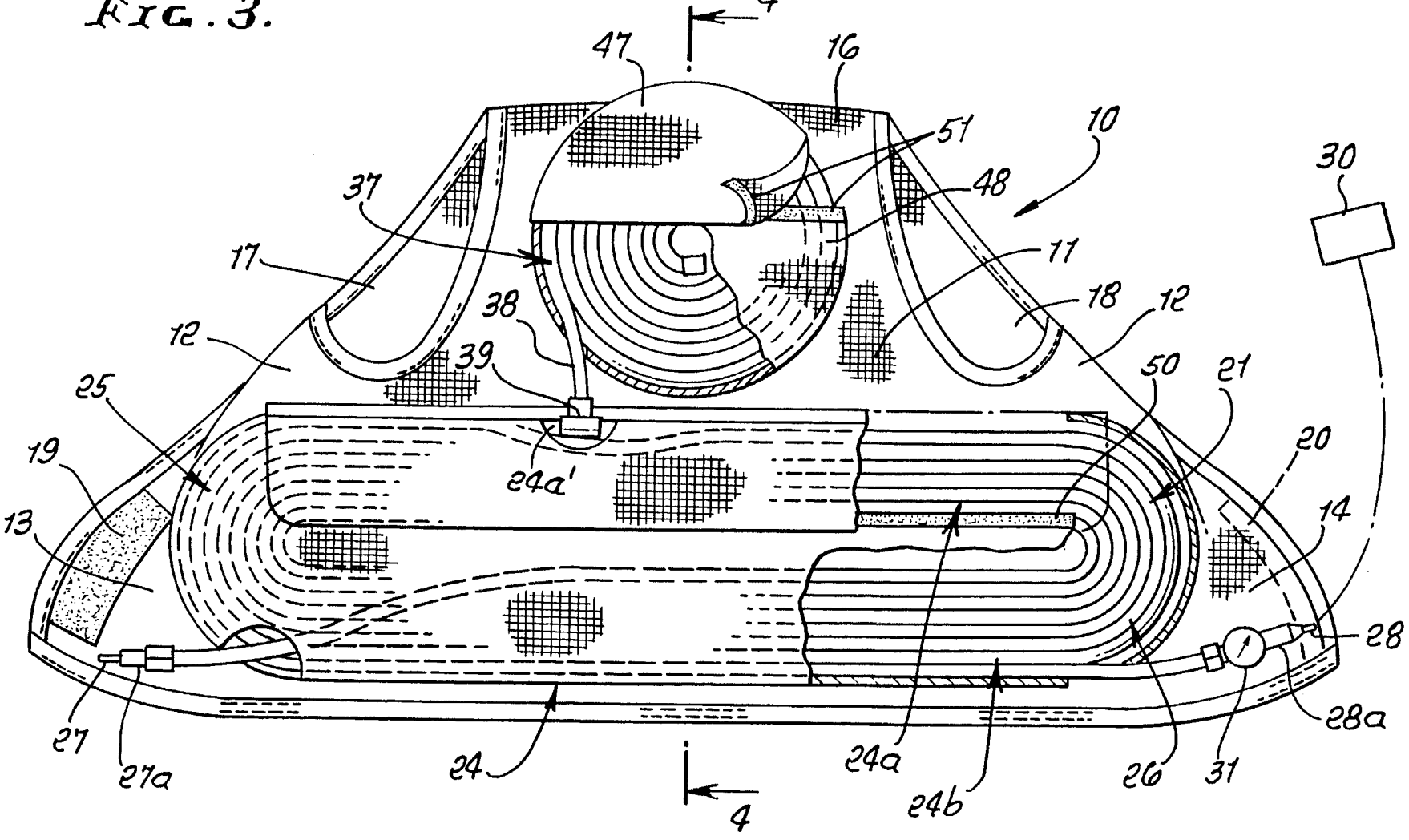
FIG. 3 is a rear view of an open jacket having positioning of pressurized gas pipe coil means.
Figure 4:
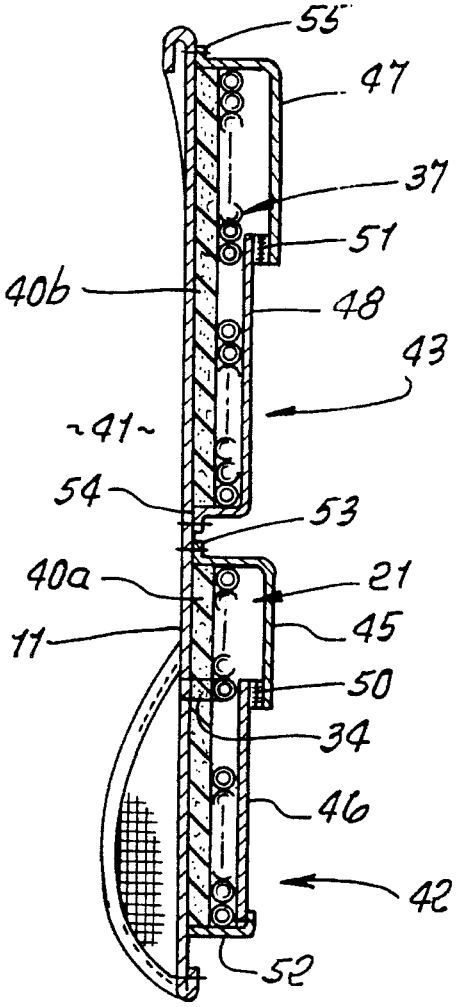
FIG. 4 is a section taken on lines 4—4 of FIG. 3.

First looping pipe coil means, indicated generally at 21, is carried by the jacket in overlying or overlapping relation to the position of the back panel structure 11, as seen in FIG. 4. That coil means 21 has flexible construction, whereby it may bend and conform to the wearer's body contour as panels flex from jacket open position, as seen in FIG. 3, to jacket worn and closed condition, as seen in FIGS. 1 and 2.

Note stacking of all the coils in a single layer, as seen in FIG. 4, the coils confined adjacent lower extent of the jacket. Coil attachment to the jacket may be by sewing, to allow freedom for flexing as indicated at 34 in FIG. 4, for example. Typical pipe or duct compositions to allow flexing include rubber hose material, as used at filling stations, to supply compressed air to vehicle tires. As shown in FIG. 3, coil means 21 extends to side panels 12 beneath 17 and 18.

Figure 5:
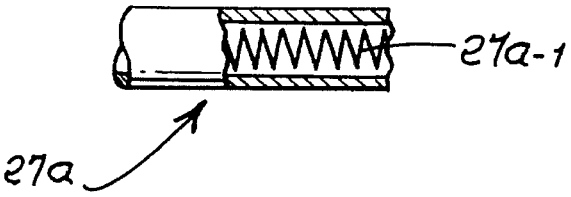
FIG. 5 is a fragmentary view of a spring-controlled valve.

The piping or ducting includes horizontal stretches 24, including upper stretch group **24*a* and lower stretch group 24*b*. Left and right pipe or duct bend groups appear at 25 and 26. All of such piping and ducting comprises one pipe or duct having an inlet end 27 and an outlet end 28. At the inlet a spring-urged check valve 27***a* allows pressurized air (or other gas) input, but blocks gas escape. See for example spring 27*a*-1 in FIG. 5. At the outlet, a manually controllable valve, and pressure regulator unit, all indicated at 28*a*, releases gas or air at reduced or regulated pressure, for flow to a face mask (indicated at 30) worn by the jacket user. A pressure gage 31 may be employed with unit 28*a*.

Second looping pipe coil means, indicated generally at 37, is carried by the jacket, in overlying relation to jacket panel structure, such as upper extent of the back panel 11, between the arm openings as shown. Thus, the pipe coil means 37 is above the medial extent of the first-described pipe or duct structure 21. The pipe or duct of structure 21 may also have flexible construction to conform to the back of the jacket wearer. The second pipe means typically comprises a single pipe or duct in coil 37, wound in a spiral, and having one end 38, thereof connected with the first pipe means, as for example to duct 24*a*' of group 24*a*, as seen in FIG. 3. Note the T-connection or fitting 39 to accomplish the connections. The opposite end of the single pipe in coil 37 may be closed. Therefore, the second coil means 37 constitutes added storage capacity, for pressurized gas.

FIG. 4 shows the provision of protective padding layers 40*a* and 40*b* extending upwardly between the coils 21 and 37, and the back 41, of the wearer. The layers 40*a* and 40*b* may comprise compressible and flexible foam plastic material. Pockets 42 and 43 to receive the coils and layers 41*a* and 41*b* may be carried by the jacket. Such pockets may include flexible upper and lower cover layers 45 and 46, associated with coil and flexible upper and lower cover layers 47 and associated with coil 37. Cover layers 45 and 47 may define cover flaps which may be lifted to gain access to the coils.

Note VELCRO connections at 50 and 51 to hold the cover flaps closed. The resilient pads 40*a* and may be received in the pockets, and the pockets attached to the jacket, as at 52–55.

Figure 6:
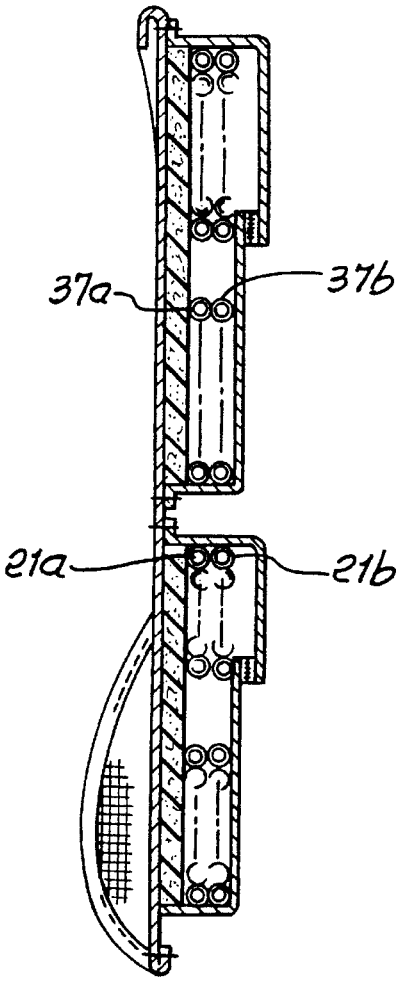
FIG. 6 is a section like FIG. 5 but showing two overlying layers of pipe coils at two locations.

FIG. 6 shows that the first pipe or duct coil means 21 may include two layers 21*a* and 21*b* of sub-coils, the two layers superimposed side-by-side, as shown. A single pipe or duct may form such dual layers. Similarly, the second pipe or duct coil means 37 may include two layers 37*a* and 37*b* of sub-coils, the two layers superimposed side-by-side as shown. A single pipe or duct forms such layer. Double gas storage capacity is thereby provided.

In FIG. 2, note outer clothing in the form of a coat 60 worn over the jacket to further conceal the piping 21 and 37.

I claim:

1. In a clothing jacket carried pressurized gas assembly, the combination comprising a) a jacket structure having a back panel, b) first looping pipe coil means carried in overlying relation to said back panel structure and having flexible construction, whereby said coil means and back panel structure may be conformed to the body of the wearer, c) said looping pipe coil means having pressurized gas inlet and outlet fittings associated therewith, whereby the looping pipe coil means may receive pressurized gas for transport by the wearer, d) said first pipe coil means including first and second flexible sub-coils extending in parallel planes and in adjacent layered relation, each of said sub-coils including multiple coil turns extending in one of said planes, e) there being pocket structure receiving both of said sub-coils, and padding carried to extend between the sub-coils and the body of the wearer, f) said jacket structure having arm openings for the arms of the wearer, said looping pipe coil means being horizontally elongated to define end turns located beneath said arm openings.

2. The combination of claim 1 wherein said jacket structure includes jacket side panels.

3. The combination of claim 1 including second looping pipe coil means carried by the jacket structure in overlying relation with said back panel and above the level of said first pipe coil means, said second pipe coil means connected with the first pipe coil means for reception of pressurized gas.

4. The combination of claim 3 wherein said second pipe coil means has flexible construction to conform to the back of the jacket wearer, above the level of the first coil means.

5. The combination of claim 3 wherein said jacket consists of flexible material.

6. The combination of claim 3 wherein said second pipe coil means extends between said arm openings.

7. The combination of claim 6 wherein said second pipe coil means comprises a spiral coil having an outer diameter and said first pipe coil means has left-to-right length at least twice said first pipe coil means diameter.

8. The combination of claim 3 wherein said second pipe coil means comprises first and second sub-coils extending in adjacent layered relation.

9. The combination of claim 7 wherein said second pipe coil means includes third and fourth sub-coils extending in adjacent, layered relation.

10. The combination of claim 1 including pressurized $O_2$ in said coil means, and valving to control the flow of said $O_2$ to an outlet supplying reduced pressure $O_2$ to the mouth of the jacket wearer.

* * * * *